US007703603B1

(12) United States Patent
Huckabee et al.

(10) Patent No.: US 7,703,603 B1
(45) Date of Patent: Apr. 27, 2010

(54) EXPANDABLE SOFTWARE PACKAGING

(75) Inventors: William W. Huckabee, Sachse, TX (US); Pamela R. Welch, Carrollton, TX (US); James G. Johnson, Fort Worth, TX (US); Jennifer L. Reeves, Frisco, TX (US); Sara D. Mattice, Farmersville, TX (US); Michael L. Locke, Dallas, TX (US); David N. Sterling, Carrollton, TX (US); Hiep Nguyen, Carrollton, TX (US)

(73) Assignee: Intuit Inc., Mountain View, CA (US)

( * ) Notice: Subject to any disclaimer, the term of this patent is extended or adjusted under 35 U.S.C. 154(b) by 294 days.

(21) Appl. No.: 11/491,633

(22) Filed: Jul. 24, 2006

(51) Int. Cl.
*B65D 85/00* (2006.01)
*B65D 77/00* (2006.01)

(52) U.S. Cl. ..... 206/307; 206/216; 206/425; 190/103

(58) Field of Classification Search ..... 206/576, 206/232, 308.1, 308.3, 425, 494, 459.5, 307; 190/21, 103–105; 229/67.3, 928, 101
See application file for complete search history.

(56) References Cited

U.S. PATENT DOCUMENTS 3,801,175 A * 4/1974 Giulie ..... 312/184
4,165,193 A 8/1979 Gestetner
4,577,772 A * 3/1986 Bigliardi ..... 220/1.5
5,020,337 A * 6/1991 Krieg ..... 62/464
5,161,731 A 11/1992 Rivlin et al.
5,251,731 A * 10/1993 Cassese et al. ..... 190/107
5,291,990 A * 3/1994 Sejzer ..... 206/748
5,474,230 A * 12/1995 Yotukura ..... 229/117.04
5,590,767 A 1/1997 Li
5,799,862 A * 9/1998 Gray ..... 229/68.1
5,833,068 A 11/1998 Fantone
5,944,423 A * 8/1999 Rabin et al. ..... 383/15
5,947,279 A * 9/1999 Lee et al. ..... 206/232

(Continued)

OTHER PUBLICATIONS

Images of Quickbooks 2005 Software box and components from http://cgi.ebay.com/Intuit-Quicken-Quickbooks-Pro-2005-Accounting-Full-Vers_W0QQitemZ270100355311QQcategoryZ80261QQrdZ1QQcmdZViewItem?hash=item270100355311, 1 page, 2005.

(Continued)

*Primary Examiner*—Ehud Gartenberg
*Assistant Examiner*—Jose S Stephens, III
(74) *Attorney, Agent, or Firm*—Osha • Liang LLP

(57) ABSTRACT

A software box or package with reduced original dimensions may be configured to be manipulated to form a box with at least one dimension that is longer than the original dimensions. For example, the box may be manipulated to form an expanded box with a longer height, depth, and/or width than the un-expanded box. In some embodiments, one or more sides of the box may be unfolded and/or one or more internal boxes may be unfolded or pulled out of the un-expanded box to form the expanded box. The expanded box may be used to store documents, back-up software copies, instructions, etc. The expanded box may have a height and width approximately the same as a file folder and may be stored in a filing cabinet. Such software boxes may include boxes for tax software, real estate software, résumés, etc.

15 Claims, 15 Drawing Sheets

U.S. PATENT DOCUMENTS

| | | | | |
|---|---|---|---|---|
| 6,039,473 | A * | 3/2000 | Bond | 383/5 |
| 6,364,108 | B1 | 4/2002 | Bin | |
| 6,382,864 | B1 | 5/2002 | Moor | |
| 6,394,336 | B1 * | 5/2002 | Beneroff et al. | 229/101 |
| 6,536,803 | B2 | 3/2003 | Masson | |
| 6,672,439 | B2 * | 1/2004 | Platte, III | 190/103 |
| 6,695,144 | B2 * | 2/2004 | Freeze | 206/768 |
| 6,796,428 | B1 * | 9/2004 | Ong | 206/425 |
| 6,837,368 | B1 * | 1/2005 | Chang | 206/232 |
| 7,017,737 | B1 | 3/2006 | Chen | |
| 7,255,239 | B2 * | 8/2007 | Liu et al. | 220/6 |
| 2002/0179475 | A1 * | 12/2002 | Kohana | 206/425 |
| 2006/0016862 | A1 * | 1/2006 | Makofsky | 229/67.3 |
| 2007/0194090 | A1 * | 8/2007 | Chou | 229/67.3 |

OTHER PUBLICATIONS

"Letter and Legal Size File Folders," The U.S. National Archives & Records Administration, Mar. 1991, 6 pages.

* cited by examiner

EXPANDABLE SOFTWARE PACKAGING

BACKGROUND

Several different types of software for private consumers and business related interests have become available. For example, financial software, tax software, legal document software, etc. are marketed and sold to make once difficult tasks easier for people or businesses to manage. Even with the increasing reliance on these software programs and computers for related electronic document storage, people still find it necessary to store paper copies of related documents for later retrieval. For example, tax returns and receipts are often stored in paper form in addition to their electronic counterparts.

Software is often sold in small packaging. Often, the size of the packaging is minimized to make the software packages easier to transport, store, and display. Once purchased, software boxes are often used by the consumer to store the original software storage medium and software instructions. The software boxes are stored separately from other paper documents (such as tax returns) because the dimensions of the other paper documents often exceed the dimensions of the software box. This may lead to cumbersome storage requirements, and may also lead to difficulties locating needed documents at a later time.

SUMMARY

In various embodiments, a software box or package with reduced original dimensions may be manipulated into an expanded box or accordion file container with at least one dimension that is longer than the original software box dimensions. For example, the box may be manipulated to form an expanded box with a longer height, depth, and/or width than the original box. In some embodiments, one or more sides of the box may be unfolded and/or one or more internal boxes may be unfolded or pulled out of the original box to form the expanded box. Other expanding configurations are also contemplated. The expanded box may use features such as tabs and slots to secure the box in the expanded configuration. The expanded box may be used to store documents (e.g., standard paper with dimensions of 8.5 inches by 11 inches or other dimensions such as 8.5 inches by 14 inches (legal) or 219 millimeters by 297 millimeters (A4)), back-up software copies, instructions, etc. The expanded box may have a height and width approximately the same as a file folder and may be stored in a standard filing cabinet. The software boxes may include boxes for tax software, real estate software, résumé software, etc.

Other features are also contemplated for such a software package. For example, different portions of the boxes may be used for communications such as promotions, advertisements, and other information. Portions may be used for instructions or helpful information. The year and/or a product/contents descriptor may be displayed prominently on a front portion of the box. In some embodiments, communications may be placed on portions of the expandable box that are not visible to a user in an un-expanded configuration but become visible in the expanded configuration. Partitions may be used in the box to separate the box into quickly identifiable segments (e.g., one segment for tax receipts, one segment for a copy of a tax return, etc). The partitions may be labeled with tabs. Pockets on the expanded box (e.g., an internal pocket) may be used for storing compact discs (CDs) or other software mediums. Hanging extensions may be used to hang the file folder in a filing cabinet with a hanging file folder configuration.

BRIEF DESCRIPTION OF THE DRAWINGS

A better understanding of the present invention may be obtained when the following detailed description is considered in conjunction with the following drawings.

Figure 1A:
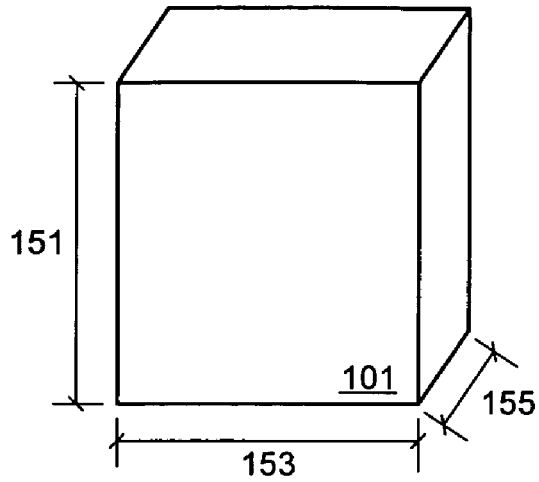
FIGS. 1*a-b* illustrate a box operable to expand, according to an embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must). The term "include", and derivations thereof, mean "including, but not limited to". The term "coupled" means "directly or indirectly connected".

DETAILED DESCRIPTION OF EMBODIMENTS

A box or package may be configured to contain a software distribution medium for a software product, where the box has an un-expanded configuration and an expanded configuration. In the un-expanded configuration, the box dimensions may be sufficient to contain the software distribution medium and possibly some related documentation or other inserts, such as installation instructions. However, in some embodiments, in the un-expanded configuration, one or more dimensions of the box may not be sufficient to store additional documents that may be related to the use of the software, such as tax forms, receipts, financial statements, etc., in a manner that provides for regular file storage. The un-expanded configuration may be used for shipping the software product to customers or retail outlets, and/or when the software product is displayed for sale, for example.

In the expanded configuration, in addition to the software distribution medium, the box may be configured to store documents that are not provided with the software product but may be related to the use of the software, such as tax forms, receipts, financial statements, etc. In one embodiment, in the expanded configuration, the box may have the approximate width and height dimensions of a standard-size (e.g., letter size) or legal-size file folder such that the box could be stored in a standard filing cabinet along with standard-size file folders. A user may store documents and papers related to the use of the software product in the expanded configuration of the box. For example, the software product may be a tax application and the user may store receipts, tax forms, financial statements, etc. in the expanded configuration of the box. In embodiments in which the expanded configuration of box approximately matches a standard-size or legal-size file folder, the entire box may then be stored in an appropriate filing cabinet along with other like documents. In some embodiments, the box may include internal partitions in the expanded configuration to facilitate document filing. These and other variations are described for various embodiments below.

Figure 1B:
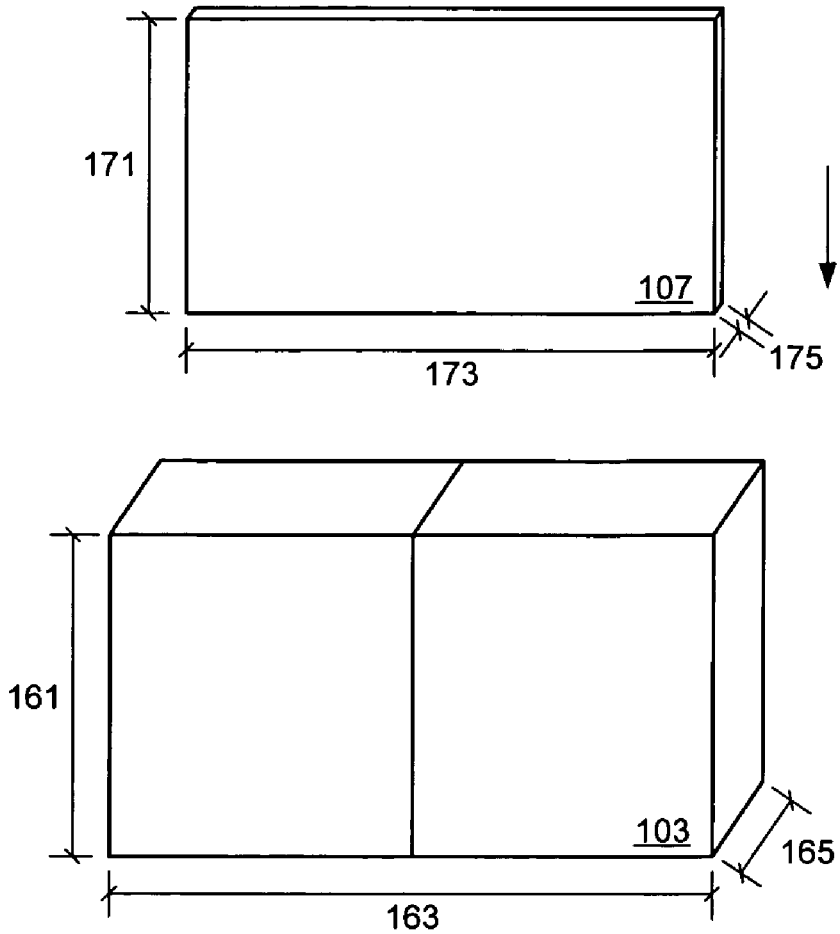

FIGS. 1*a-b* illustrate an embodiment of an expandable box or package 101 for a software product in an un-expanded first configuration operable to be expanded into a larger second configuration. In some embodiments, a software box 101 may have a first volume with an original first height 151, first depth 155, and first width 153. In some embodiments, the box 101 may be manipulated to form an expanded box 103 with a second configuration. The second configuration may have a second volume with a second height 161, a second depth 165, and a second width 163 (at least one of which may be longer than the corresponding first height 151, first depth 155, and first width 153). For example, the box 101 may be manipulated to form the expanded box 103 with a longer second height 161, second depth 165, and/or second width 163 than the first configuration (an embodiment with a longer second width 163 is shown in FIG. 1*b*). The second configuration may be operable to receive a document medium (e.g., a paper medium 107) with dimensions of third height 171, third depth 175, and third width 173 (at least one dimension of the medium may exceed at least one corresponding first height 151, first depth 155, and first width 153 of the first configuration). For example, the second configuration may be operable to enclose paper with approximate dimensions of 8.5 inches by 11 inches, 8.5 inches by 14 inches or 219 millimeters by 297 millimeters.

In some embodiments, the software box 101 may be used to hold a distribution medium (e.g., CD ROM or other computer-accessible medium) for one or more various types of software including tax software, real estate software, résumé software, etc. The box 101 may include an internal compartment, sleeve, slot, etc. (not shown) for holding the software distribution medium. In some embodiments, in the first un-expanded configuration, the box dimensions may be sufficient to enclose the software distribution medium and possibly some related documentation or other inserts, such as installation instructions. However, in some embodiments, the un-expanded volume may not be sufficient to store additional documents that may be related to the software application, such as tax forms, receipts, financial statements, etc., in a manner that provides for regular file storage. In the expanded second configuration, the expanded box 103 may also be used to store such documents (e.g., including standard size paper with dimensions of 8.5 inches by 11 inches or other dimensions such as 8.5 inches by 14 inches or 219 mm by 297 mm), back-up software copies, instructions, etc. For example, a tax software box 101 may expand for storage of a printed copy of a tax return, W-2s, receipts, and other tax documentation. As another example, users may store multiple releases and support documentation in the expanded box 103. The expanded box 103 may have a height and width approximately the same as a file folder and may have dimensions appropriate for storing in a filing cabinet.

In some embodiments, the box 101 may have internal or external portions that fold out to form the expanded box 103. For example, the box 101 may have one or more flaps that fold out. The box 101 may have an interior box that is pulled out to expand the box 101 into box 103. The box 101 may include fasteners to secure it in the un-expanded configuration and/or fasteners or other structures to secure the box 103 in the expanded configuration. In some embodiments, an internal volume of the expanded box 103 may be greater than the un-expanded box 101. In some embodiments, the internal volume of the expanded box may be the same or less than the un-expanded box.

Figure 2A:
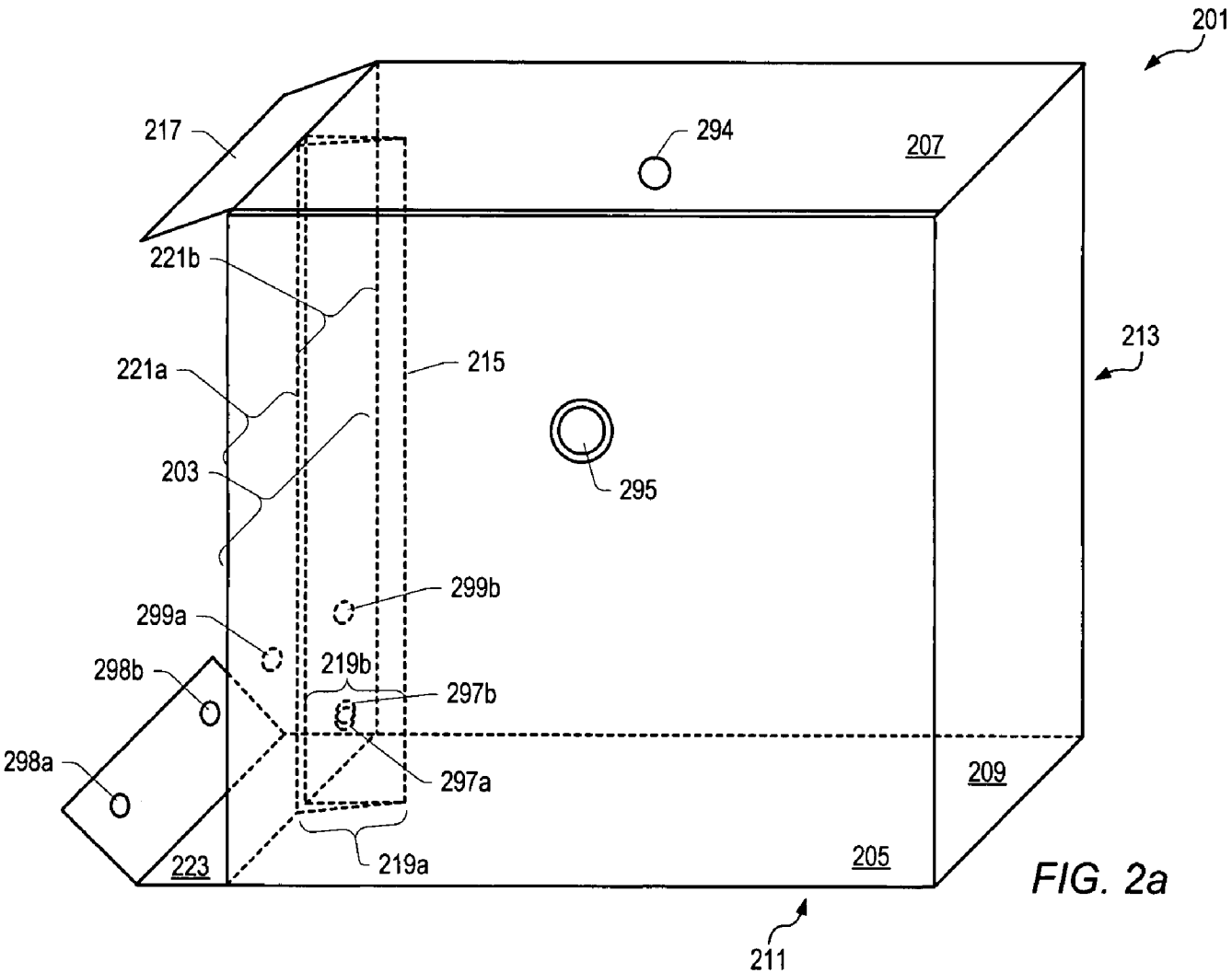
FIGS. 2*a-b* illustrate a box expandable along one side, according to an embodiment.
Figure 2B:
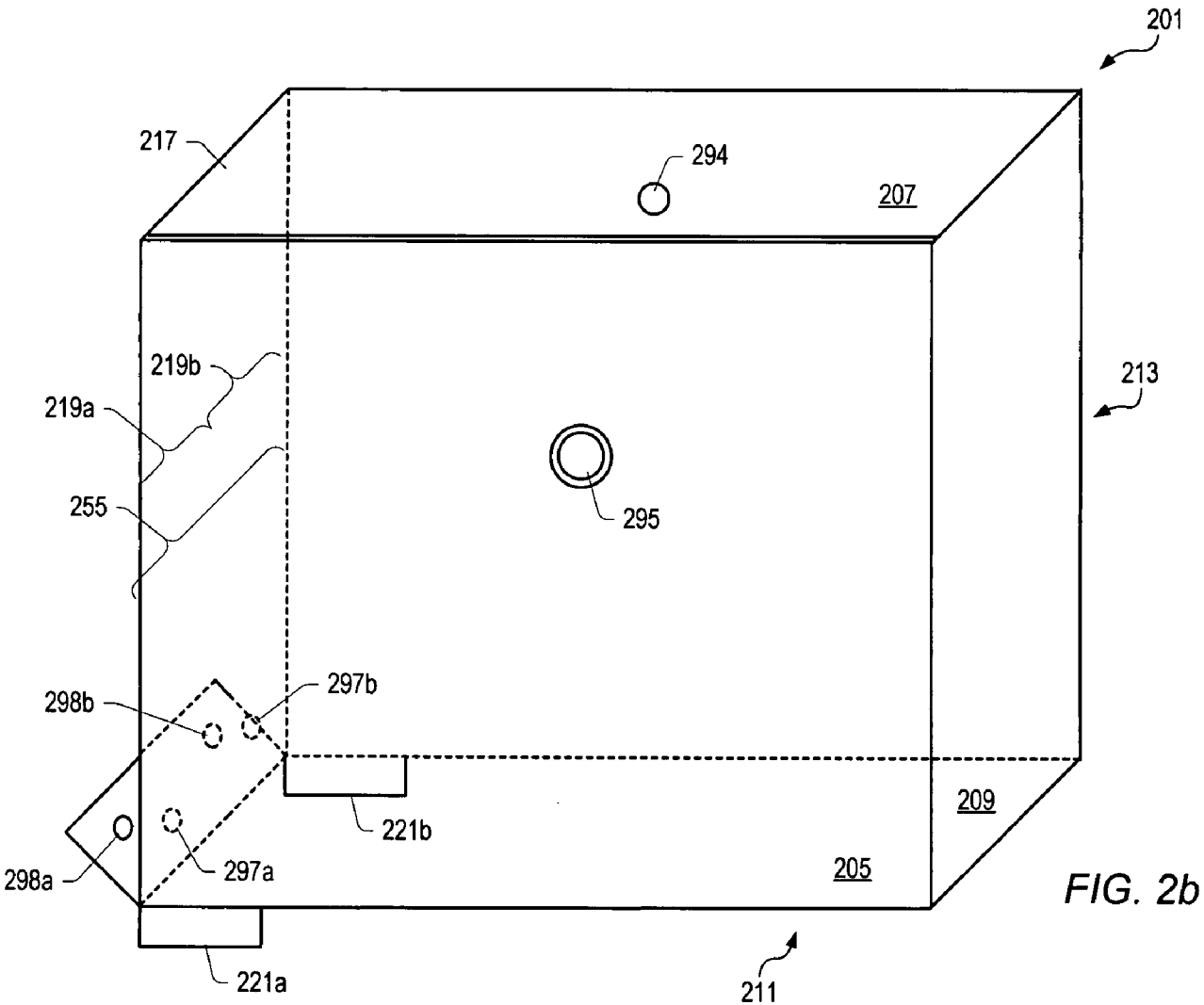

FIGS. 2*a-b* show another embodiment of a box 201 in a first configuration (FIG. 2*a*) configured to be expandable into a second configuration (FIG. 2*b*). The box 201 may be configured to contain a software distribution medium as described above. The box 201 may include a first side 203 (e.g., a left lateral side), second side 205 (e.g., a front), third side 213 (e.g., a back), fourth side 209 (e.g., a right lateral side), fifth side 211 (e.g., a bottom), and sixth side 207 (e.g., a top). The first side 203 may include a folded portion 215. The folded portion 215 may be unfolded outwardly to expose portions 219*a* and 219*b*. As seen in FIGS. 2*a* and 2*b*, portions 219*a* and 219*b* may form a new first side 255 (which may have approximately the same dimensions as original first side 203) while portions 221*a* and 221*b* of the original first side 203 may expand second side 205 and third side 213. Portion 221*a* may become part of the expanded second side 205 and portion 221*b* may become part of the expanded third side 213. Box 201 in this second configuration may have approximately the same height and depth of the first configuration but may have a longer width than the first configuration. The longer width and original height may approximately match the dimensions of a file folder (e.g., with dimensions of height slightly greater than approximately 8⅝ inches and a width slightly greater than approximately 11¾ inches (other dimensions are also possible)).

In some embodiments, the sixth side 207 (e.g., the top side of the box) may include a lid. M expandable portion 217 (e.g., a top side flap) may be coupled to the lid to unfold to expand the sixth side 207. In some embodiments, the expanded lid may cover an opening created by the extension of the second and third sides. In some embodiments, the sixth side 207 may include button 294 to engage button 295 on second side 205 for securing the lid with a string or rubber band. Other ways of securing the lid are also possible. Fifth side 211 may have an expandable portion 223 that may unfold to expand the fifth side 211. In some embodiments, Velcro™ 298*a,b* and 299*a,b* may be used to secure the box in the un-expanded configuration while Velcro™ 298*a,b* and 297*a,b* may engage to secure the fifth side 211 in the expanded configuration (note Velcro™ 299*a,b* has been omitted in FIG. 2*b* for clarity). Other fasteners are also contemplated for securing the box 201 in the expanded configuration.

Figure 3:
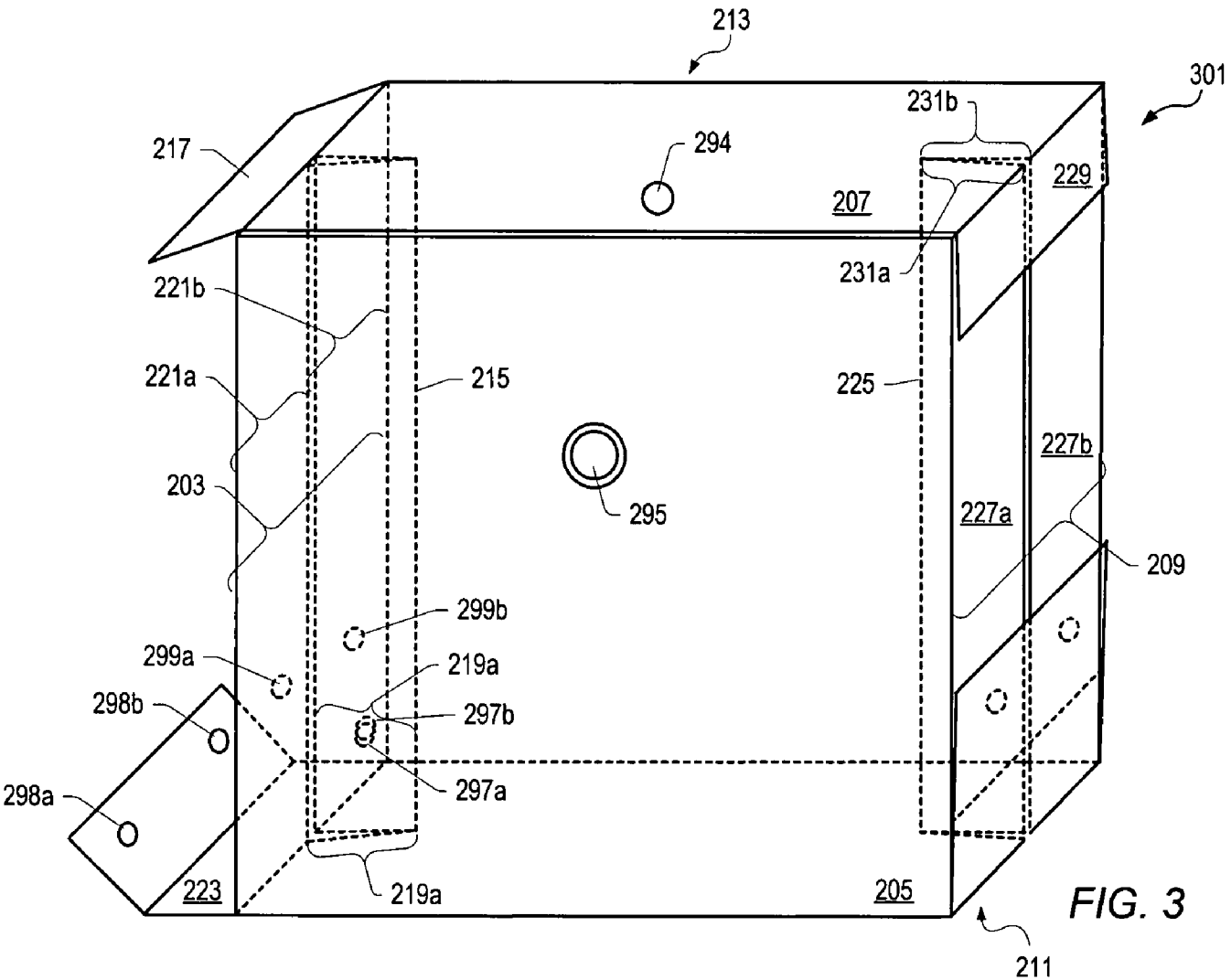
FIG. 3 illustrates a box expandable along two sides, according to an embodiment.
Figures 4A, 4B, 4C, 4D:
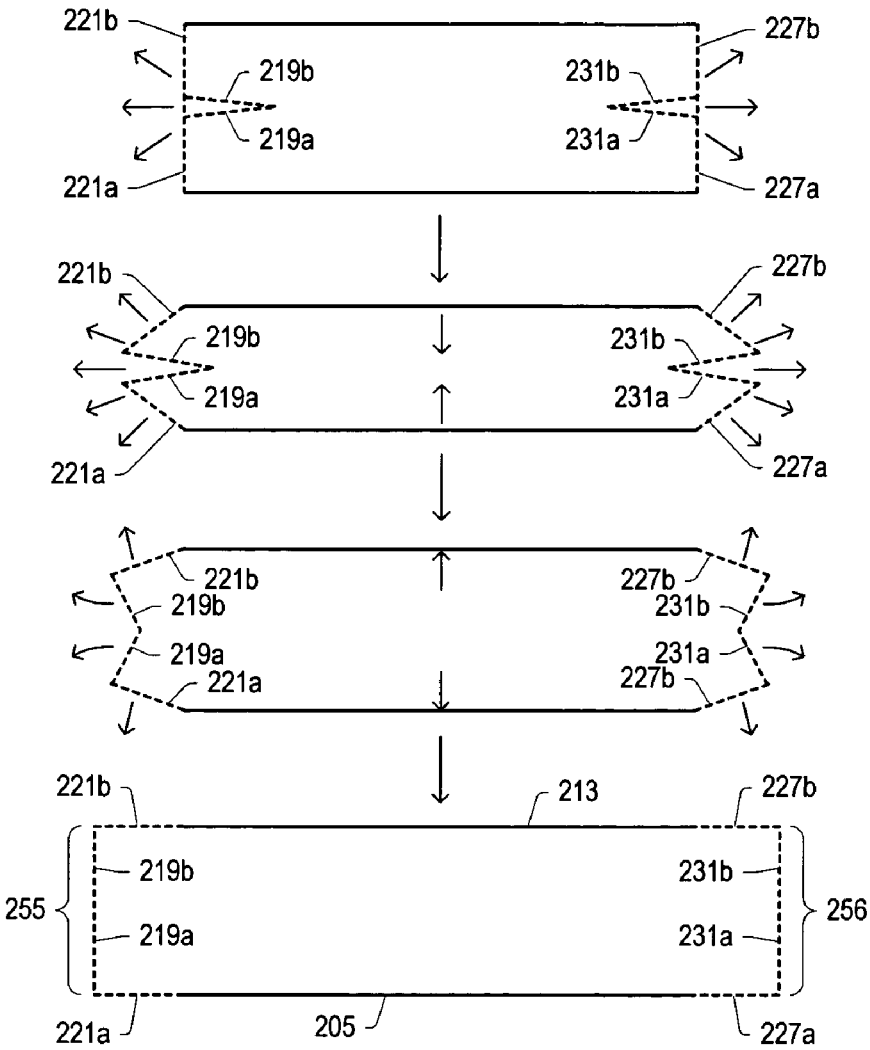
FIGS. 4*a-d* illustrate the expansion of the box shown in FIG. 3, according to an embodiment.

FIG. 3 illustrates an embodiment of a box 301 in a first configuration configured to be expandable along two sides into a third configuration. FIGS. 4*a-d* illustrate the expansion of the box shown in FIG. 3 from a superior view, according to an embodiment. The box 301 may be configured to contain a software distribution medium as described above. Folded portion 225, on the fourth side 209, may also be unfolded outwardly to expose portions 231*a* and 231*b*. Portions 231*a* and 231*b* may form new side 256 (as seen in FIG. 4*d*), while portions 227*a* and 227*b* of the original fourth side 209 may expand the second side 205 and third side 213. Portion 227*a* may become part of the expanded second side 205 and portion 227*b* may become part of the expanded third side 213. One or more other sides of the box 301 may also be expanded by unfolding a folded portion. In some embodiments, the folded portion may not be internal to box 301 (e.g., the folded portion may be external to box 301 and/or folded over on to a side of the box 301). The lid may have an expandable portion 229 that may unfold to expand the sixth side 207.

Figure 5:
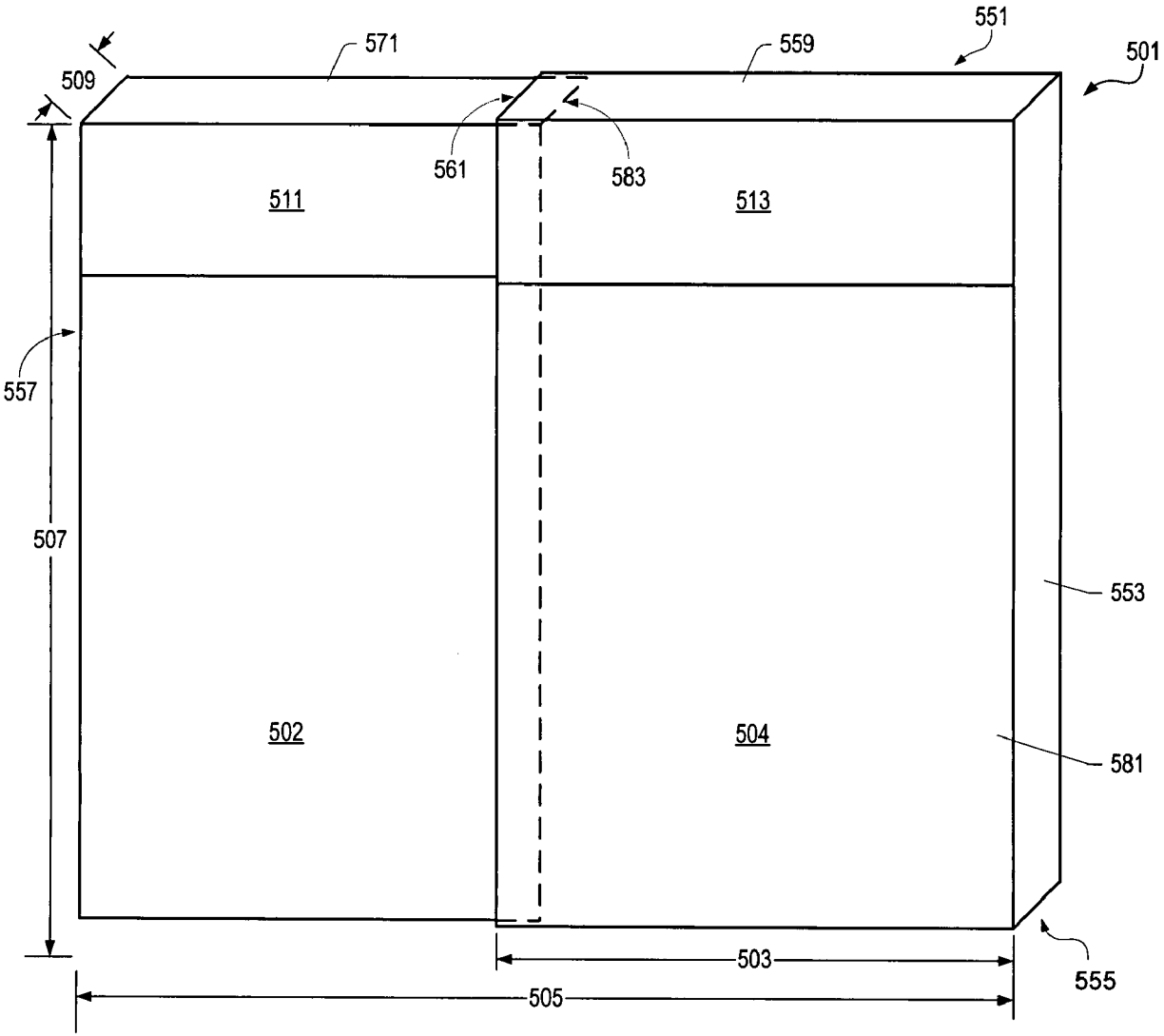
FIG. 5 illustrates an embodiment of an expandable box that comprises two boxes, according to an embodiment.

FIG. 5 illustrates an embodiment of an expandable box 501 that comprises first box 504 and second box 502. Second box 502 may fit at least partially inside first box 504. First box 504 may be enclosed on four sides (581 (e.g., a front), 555 (e.g., a bottom), 553 (e.g., a right lateral side), and 551 (e.g., a back)), with a wrap-over lid 513 to enclose a fifth side 559. The sixth side 561 may be open to allow insertion and removal of second box 502. Second box 502 may be configured to expand out of the open sixth side 561 of box 504 to form a combined box with at least one dimension longer than at least one corresponding dimension of second box 502 or first box 504. For example, with second box 502 pulled out, an original width 503 may be expanded to a longer width 505. In this example, other dimensions may be substantially unaffected (e.g., the height 507 and depth 509 may stay approximately the same). Side 571 may be part of lid 511 and side 559 may be part of lid 513. Sides 571 and 559 may therefore open with the lids 511 and 513 to open the entire top of the box 501. In some embodiments, second box 502 may not have a sidewall 583, and therefore, expanded box 501 may allow insertion of documents with width approximately equal to width 505.

In some embodiments, the expanded box may have a height slightly greater than approximately 8⅝ inches and a width slightly greater than approximately 11¾ inches (other dimensions are also possible). In some embodiments, first box 504 and second box 502 may have an interlocking mechanism to lock the boxes into an expanded box configuration. For example, one or more slots 607*a-c* along an edge of second box 502 may engage one or more tabs 605*a-c* along an edge of first box 504 to lock the two boxes 502 and 504 in the expanded box configuration. The boxes 502 and 504 may be unlocked by disengaging the tabs 605*a-c* from the slots 607*a-c* (e.g., see FIG. 6). Other ways of interlocking the boxes are also contemplated (e.g., adhesive). A wrap-over lid 511 on box 502 and wrap-over lid 513 on box 504 may be used to cover their corresponding openings in first box 504 and second box 502. The lids 511 and 513 may also be configured to interlock to form one combined lid.

Figure 7A:
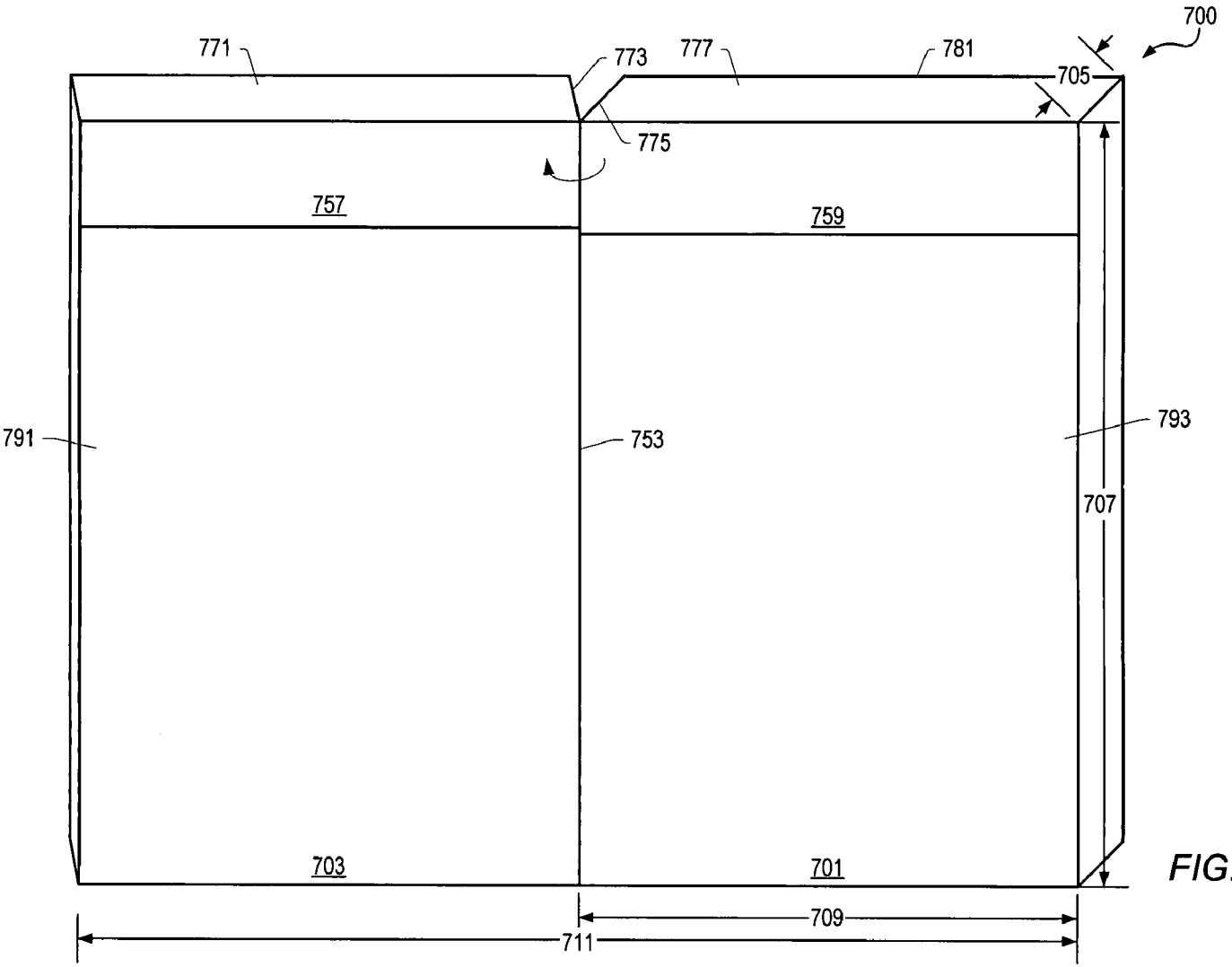
FIGS. 7*a-c* illustrates a box with two fold out components that form an expanded configuration, according to an embodiment.
Figure 7B:
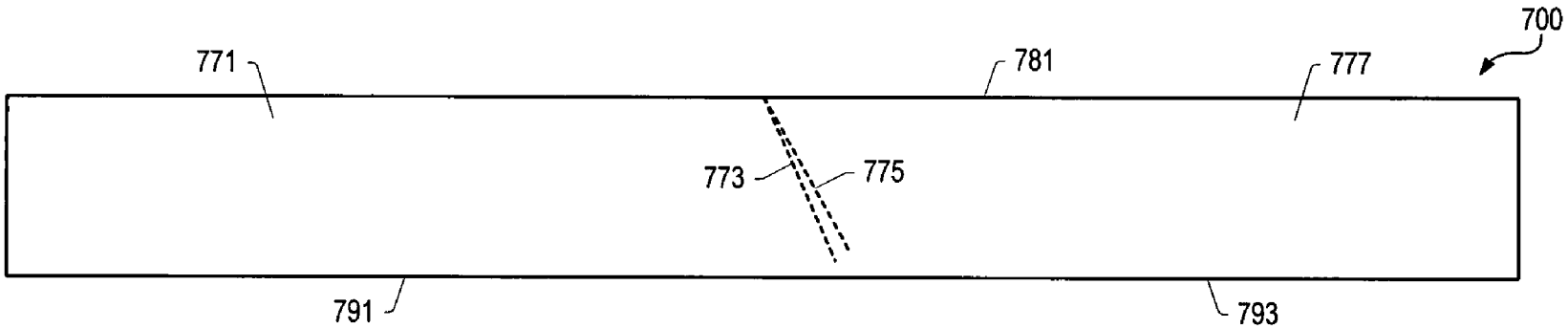
Figure 7C:
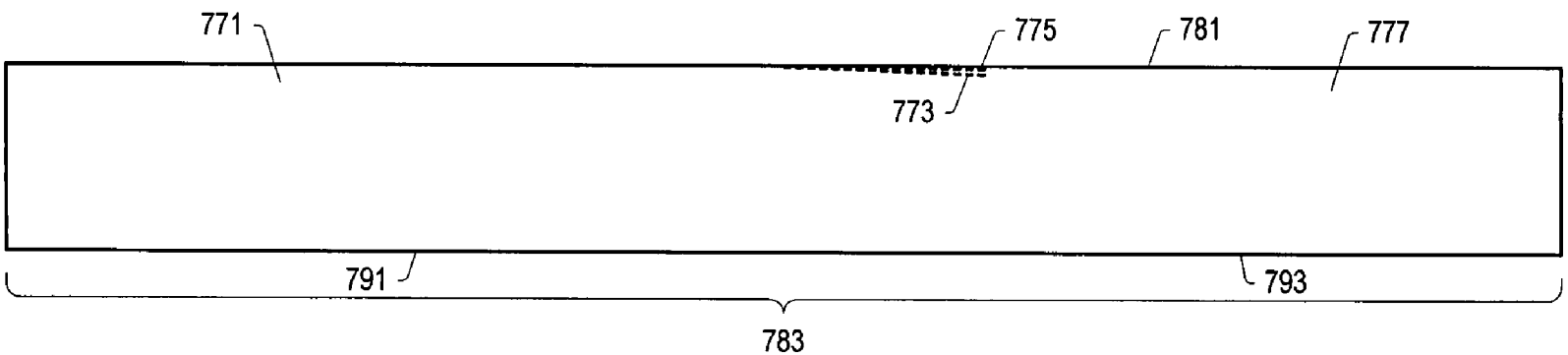

FIGS. 7*a-c* illustrate an embodiment of a box with two fold out components that form an expanded configuration. First fold out section 703 may be enclosed on all six sides. The fold out section 703 may initially be folded on top of section 701 along fold 753 (to form a box with a width approximately twice the depth 705.) Height 707 of the un-expanded box and the expanded box may be approximately the same. Width 709 of the un-expanded box may expand to approximately width 711 in the expanded box. Side flaps 773 and 775 may unlock from hinge 753 and/or walls 791 and 793 and may fold flat (e.g., against wall 781) to form an expanded opening 783 spanning the width 711 of the expanded box. Wrap-over lid 757 (forming part of side 771) and wrap-over lid 759 (forming part of side 777) may interlock to form one interconnected lid to cover the expanded opening 783.

Figure 8:
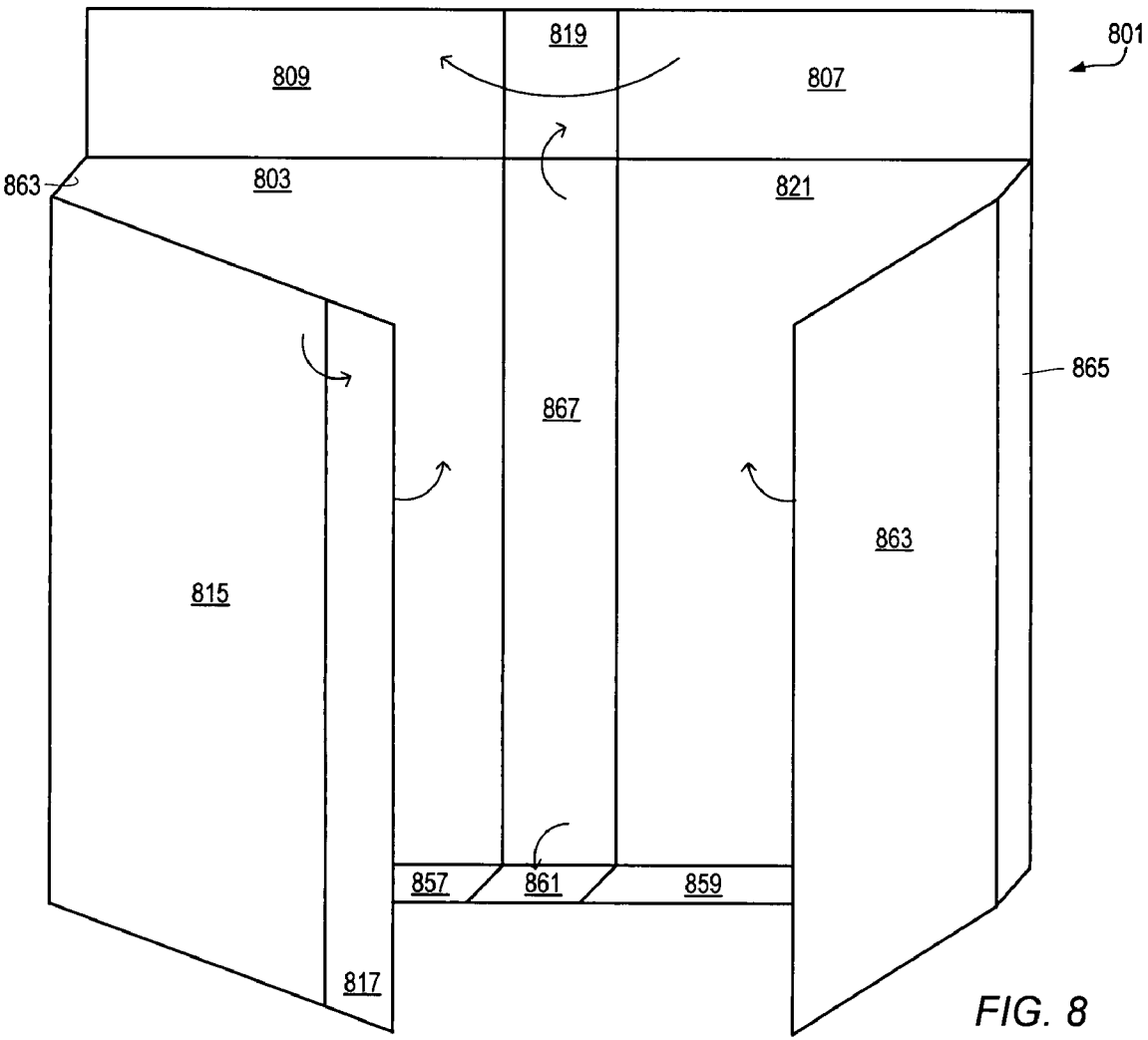
FIG. 8 illustrates another embodiment of a fold out box.

FIG. 8 illustrates a fold out box 801, according to an embodiment. Section 803 may unfold from section 821. Floor 857 of section 803 may overlap floor 859 of section 821 when in the folded position. Wall 863 may fit inside wall 865. Wall 867 may form the left side wall and flap 863 may form the front side when the box is in the folded position. Flap 817 may unfold from flap 815 to extend flap 815 to meet flap 863 to form the extended front wall when the section 803 is unfolded. Flap 863 and flap 815/817 may interlock (e.g., with tabs and slots) when the box is in the expanded position. Flap 819 and flap 809 may also be folded into the box when in the folded position and may fold out to form a wrap-over lid for the expanded box (along with flap 807). Flaps 819, 809, and 807 may interlock to form the extended lid. Sections 803 and 821 may be sufficiently rigid to maintain the form of the expanded box (e.g., the box may be made of a stiff cardboard). Other materials are also possible (e.g., plastic).

Figure 9:
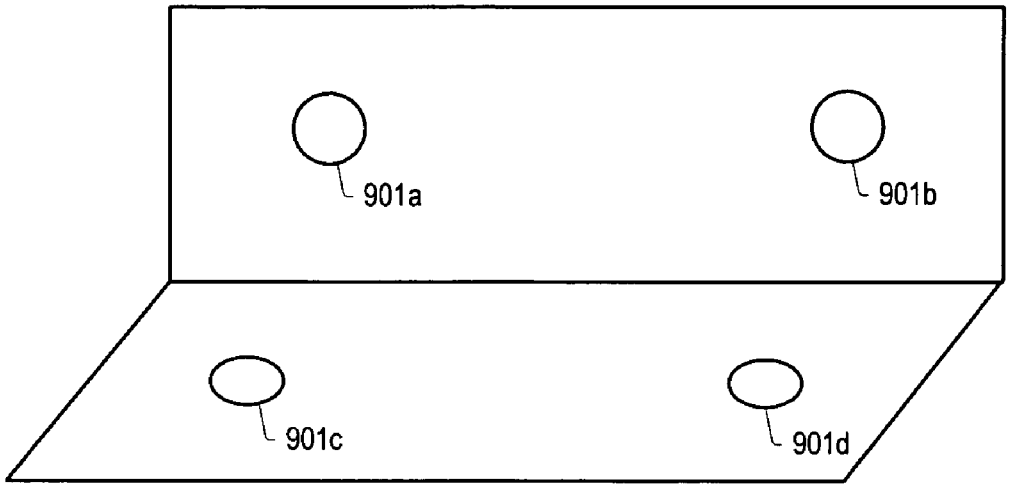
FIG. 9 illustrates a Velcro™ connection, according to an embodiment.
Figure 10:
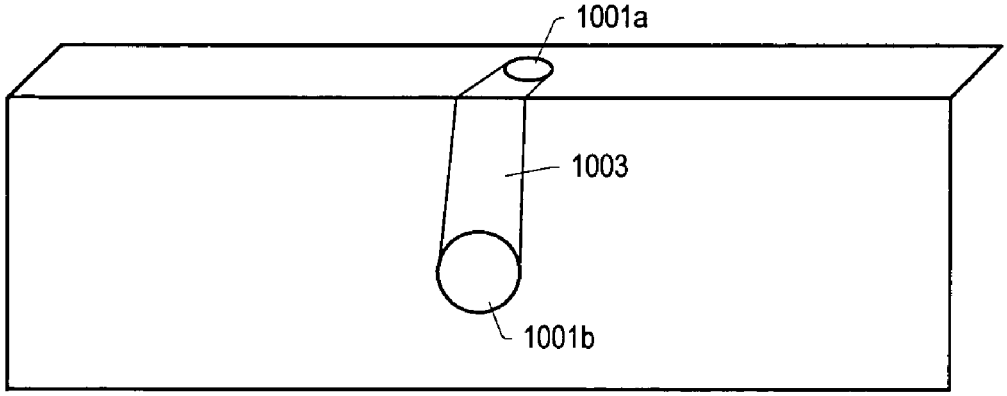
FIG. 10 illustrates a button and string connection, according to an embodiment.
Figure 11:
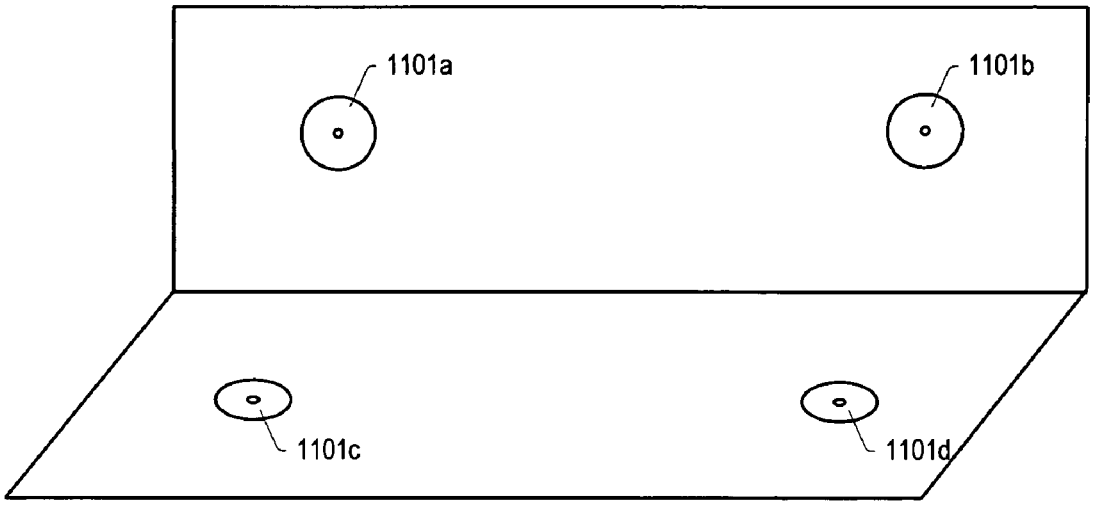
FIG. 11 illustrates a snap connection, according to an embodiment.

As discussed above, the lids and box sides may be interlocked and/or secured in various ways. Velcro™ 901*a-d* (FIG. 9), buttons 1001*a-b* and rubber bands or strings 1003 (FIG. 10), and snaps 1101*a-d* (FIG. 11) may be used to secure lids and or sides in various embodiments. Other interlocking mechanisms are also contemplated (e.g., adhesive).

Figure 12:
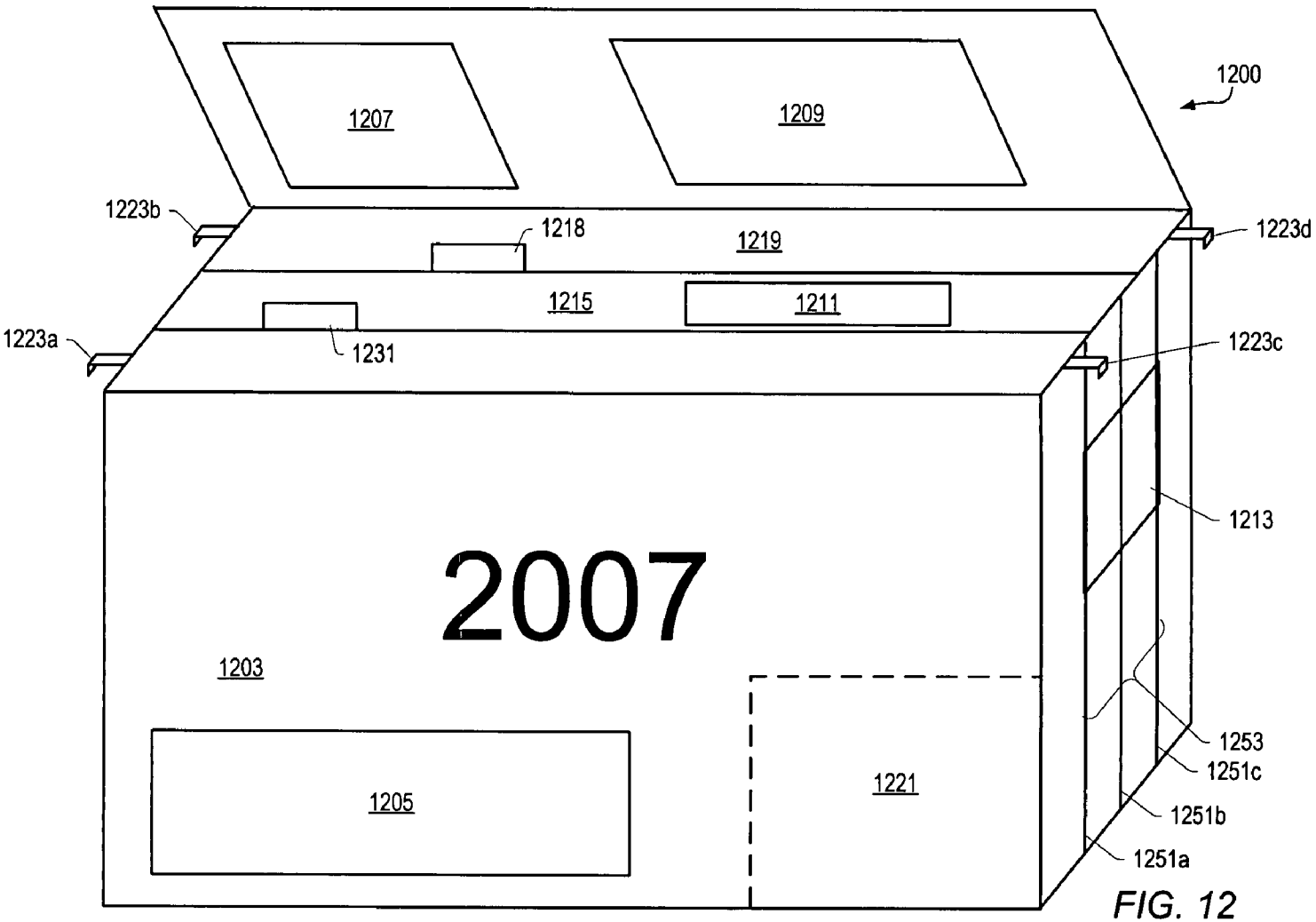
FIG. 12 illustrates various features for various embodiments.

FIG. 12 illustrates various features for various embodiments. FIG. 12 illustrates a box 1200 in an expanded configuration (e.g., as described in regard to any of FIGS. 1-8). In some embodiments, different portions of the box 1200 (e.g., portions 1205, 1207, and 1213) may be used for communications such as promotions, advertisements, and other information. Other communications are also contemplated (e.g., portion 1209 may be used for instructions or helpful information). A web address and technical support/product support phone numbers for the product may also be printed on the box (e.g., at position 1211). In some embodiments, the communications may be placed on portions (e.g., folds, flaps, partitions, tabs, etc.) that are not visible to a user in the un-expanded first configuration but become visible in the expanded second configuration. For example, in one embodiment, portion 1213 may become visible when box 1200 is expanded through folds 1251*a-c* to expose section 1253. The year and content/product description may be displayed prominently (e.g., year 2007 on portion 1203). Partitions 1215 may be used to separate the box 1200 into quickly identifiable segments (e.g., one segment for tax receipts, one segment for a tax return copy, etc). The partitions 1215 and/or box 1200 may be color coded according to year. The partitions 1215 may be labeled with tabs (e.g., tabs 1231 and 1218). The partitions 1215 and 1219 may fold and unfold depending on whether the box 1200 is in an un-expanded or expanded configuration. The tabs 1231 and 1218 may be fixed or may fold out (e.g., the tabs 1231 and 1218 may fold out when the box 1200 is in the expanded configuration). The internal partitions 1215 and 1219 may be used to sort the documents in the box 1200 (e.g., copy of a tax return in one partition, receipts in another partition, and W-2's in another partition.) In some embodiments, the partitions 1215 and 1219 may fold/unfold and/or interlock depending on the configuration of the box 1200 as it expands into an expanded configuration. Other uses of the partitions 1215 and 1219 are also contemplated. Pockets (e.g., internal pocket 1221) may be used for storing compact discs (CDs) or other software mediums. Hanging extensions (e.g., extensions 1223*a, b, c*, and *d*) may be used to hang the file folder in a filing cabinet with a hanging file folder configuration. In some embodiments, the hanging extensions may be retractable or foldable so as to not extend from the box in the un-expanded configuration of the box. Any or all of the features shown with respect to FIG. 12 may be used on any of the above embodiments as well as other embodiments of the expandable box.

Figure 13:
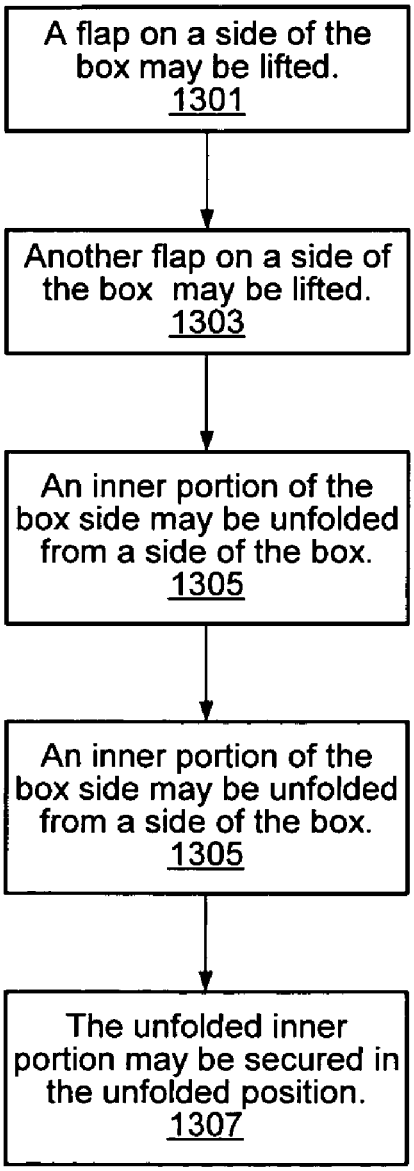
FIG. 13 illustrates a method for expanding a box, according to an embodiment.

FIG. 13 illustrates a method for expanding a box (e.g., box 201 in FIG. 2*a*), according to an embodiment. It should be noted that in various embodiments of the methods described below, one or more of the elements described may be performed concurrently, in a different order than shown, or may be omitted entirely. Other additional elements may also be performed as desired.

At 1301, a flap (e.g., expandable portion 217) on a side of the box 201 may be lifted. At 1303, another flap (e.g., expandable portion 223) on a side of the box 201 may be lifted. At 1305, an inner portion of the box side (e.g., including portions 219*a*, 219*b*, 221*a*, and 221*b*) may be unfolded from a side 203 of the box 201. At 1307 the unfolded inner portion may be secured in the unfolded position (e.g., by applying Velcro™ fasteners 298*a*, 298*b*, 299*a*, and 299*b*). In some embodiments, the box (e.g., box 301 in FIG. 3) may be expanded along another side using a similar method as described above.

Figure 14:
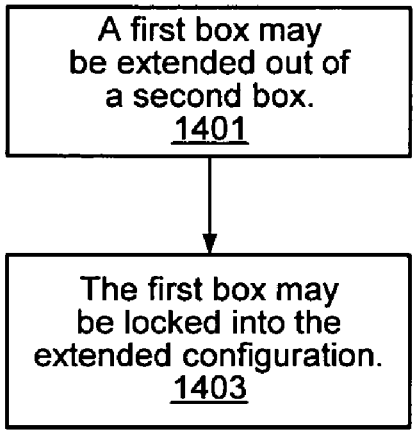
FIG. 14 illustrates a method for expanding a box, according to another embodiment.

FIG. 14 illustrates a method for expanding a box (e.g., box 501 in FIG. 5), according to another embodiment. It should be noted that in various embodiments of the methods described below, one or more of the elements described may be performed concurrently, in a different order than shown, or may be omitted entirely. Other additional elements may also be performed as desired.

Figure 6:
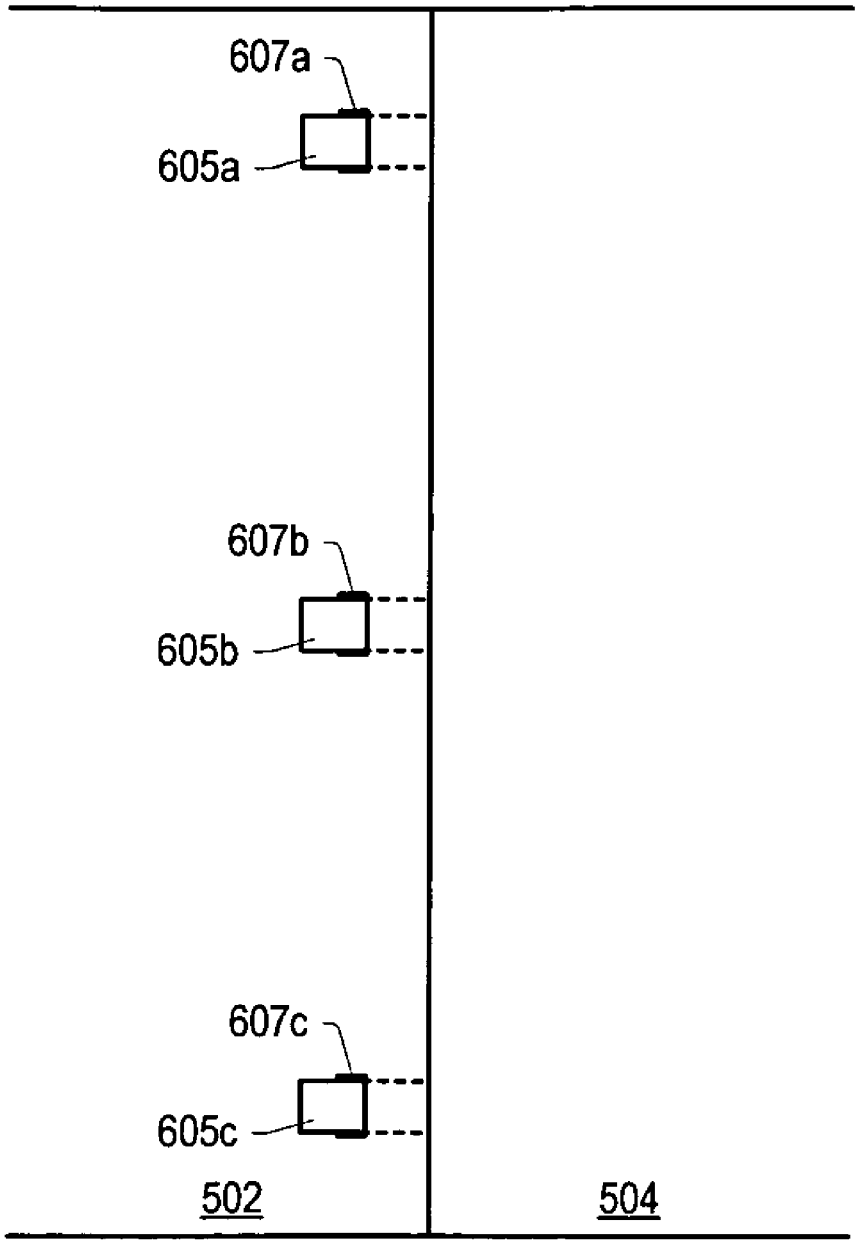
FIG. 6 illustrates an embodiment of a tab and slot configuration for interlocking to secure a box in an expanded configuration, according to an embodiment.

At 1401, a first box 502 may be expanded out of a second box 504. At 1403, the first box 502 may be locked into the expanded configuration (e.g., using a tab 605/slot 607 system as seen in FIG. 6).

Figure 15:
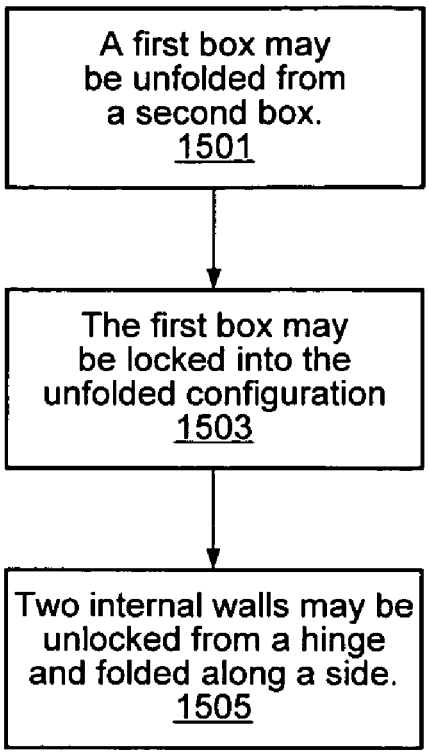
FIG. 15 illustrates a method for expanding a box by unfolding a first box from a second box, according to an embodiment.

FIG. 15 illustrates a method for expanding a box (e.g., box 700 in FIG. 7*a*) by unfolding a first box from a second box, according to an embodiment. It should be noted that in various embodiments of the methods described below, one or more of the elements described may be performed concurrently, in a different order than shown, or may be omitted entirely. Other additional elements may also be performed as desired.

At 1501, a first box 703 may be unfolded from a second box 701. For example, the first box 703 may be attached to second box 701 at a hinge 753 and may be on top of box 701 when the box 700 is in a folded position. The first box 703 may then fold out along the hinge 753.

At 1503, the box 703 may be locked into the unfolded expanded configuration (e.g., using a tab 605/slot 607 system along a back side of box 703 and box 701). At 1505, two internal walls 773 and 775 may be unlocked from hinge 753 and folded along a side (e.g., side 781). Folding down walls 773 and 775 may provide opening 783.

Figure 16:
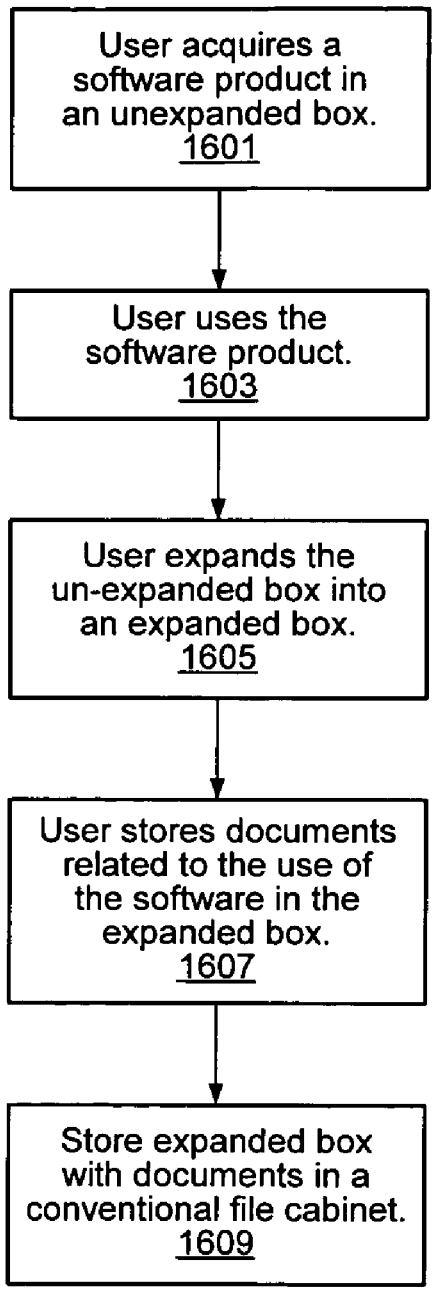
FIG. 16 illustrates a method of using the expandable box, according to an embodiment.

FIG. 16 illustrates a method of using the expandable box, according to an embodiment. It should be noted that in various embodiments of the methods described below, one or more of the elements described may be performed concurrently, in a different order than shown, or may be omitted entirely. Other additional elements may also be performed as desired.

At 1601, a user may acquire a software product in an un-expanded box. For example, the user may purchase tax software, real estate software, résumé software, etc. in an un-expanded box at a retail store. The software products may be more convenient to ship and display in the un-expanded boxes.

At 1603, a user may use the software product. The user may take the product home in the un-expanded box, open the box, and install and use the included software. In using the software, the user may use external documents and/or generate documents related to the software.

At 1605, a user may expand the un-expanded box into an expanded box. For example, as noted above, the user may expand portions of the box by unfolding and otherwise extending the box into an expanded configuration.

At 1607, a user may store documents related to the use of the software in the expanded box. For example, the user may store the external documents and/or generated documents in the expanded box. Other documents may also be stored in the expanded box (e.g., the software instructions).

At 1609, the expanded box with documents may be stored in a conventional file cabinet. For example, the conventional file cabinet may be configured to store standard letter sized documents or legal sized documents. Other file cabinet sizes are also possible.

Further modifications and alternative embodiments of various aspects of the invention may be apparent to those skilled in the art in view of this description. For example, although embodiments have been described primarily in terms of a box, the concepts described above apply equally to any geometric packaging configuration, including any polygon, round or spherical shape. In some embodiments, regardless of the shape of the package, the package may still be configured to fit within a standard file shelf or cabinet when in the expanded configuration and/or hold letter or legal sized documents without folding when in the expanded configuration. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An apparatus, comprising:

a software distribution medium; and an expandable package configured to store the software distribution medium and a plurality of documents, wherein the expandable package has an unexpanded configuration with an unexpanded volume, wherein the expandable package is configured to expand to an expanded configuration with an expanded volume, wherein in the expanded configuration the expandable package has at least one dimension greater than in the unexpanded configuration, wherein the expandable package is configured to enclose the plurality of documents in the expanded configuration, wherein at least one dimension of the plurality of documents exceeds at least one corresponding dimension of the expandable package in the unexpanded configuration, wherein the expandable package comprises at least a first side, a second side, a third side, and a fourth side coupled to each other, wherein the second side and third side are on opposing sides of the package and the first side and the fourth side are on opposing sides of the package, wherein the first side is configured to expand into the expandable configuration to accommodate the plurality of documents by unfolding a first side flap folded into the first side, wherein the first side flap comprises a first plurality of expandable portions and a first plurality of folds, wherein when the first side flap is unfolded, at least one of the first plurality of expandable portions of the first side flap expands the second side and at least a different one of the first plurality of expandable portions of the first side flap expands the third side, wherein the fourth side is configured to expand into the expandable configuration to accommodate the plurality of documents by unfolding a fourth side flap folded into the fourth side, wherein the fourth side flap comprises a second plurality of expandable portions and a second plurality of folds, and wherein when the fourth side flap is unfolded, at least one of the second plurality of expandable portions of the fourth side flap expands the second side and at least a different one of the second plurality of expandable portions of the fourth side flap expands the third side, wherein the expandable package further comprises a communication printed on the first plurality of expandable portions and the first plurality of folds of the first side flap, wherein the communication is not visible to a user when the first side flap is folded into the first side in the unexpanded configuration having the unexpanded volume, wherein the communication is visible to the user when the first side flap is unfolded from the first side in the expanded configuration having the expanded volume, and wherein the expanded volume exceeds the unexpanded volume, and wherein the expandable package further comprises:

a first pair of fasteners affixed to two different folds of the first plurality of folds, wherein the first pair of fasteners are coupled with each other to keep the package in the unexpanded configuration, a second pair of fasteners affixed to an expandable portion that extends from the second side of the package, a third pair of fasteners affixed to two different portions of the first plurality of expandable portions, wherein the second pair of fasteners are coupled with the third pair of fasteners in the unexpanded configuration, and wherein the first pair of fasteners are coupled with the second pair of fasteners in the expanded configuration.

2. The apparatus of claim 1, wherein the expandable package is operable in the expanded configuration to enclose a document with approximate dimensions of 8.5 inches by 11 inches.

3. The apparatus of claim 1, wherein the expandable package comprises a folded portion that is operable to unfold to expand the expandable package into the expanded configuration.

4. The apparatus of claim 1, further comprising at least one partition internal to the expandable package.

5. The apparatus of claim 1, wherein the expandable package comprises a first portion with an opening on at least one side and a second portion, at least partially inside the first portion opening, wherein the second portion is configured to be moved out of the opening on the at least one side of the first portion to expand the expandable package, and wherein the first portion and second portion are configured to interlock to form the expanded configuration.

6. An apparatus, comprising:

an expandable software package configured to expand from a first configuration with a first volume to a second configuration with a second volume, wherein the first configuration is operable to enclose a software medium, wherein the second configuration has at least one dimension larger than a corresponding dimension of the first configuration, and wherein the second configuration is operable to enclose a plurality of documents, wherein the expandable software package comprises at least a first side, a second side, a third side, and a fourth side coupled to each other, wherein the second side and third side are on opposing sides of the expandable software package and the first side and the fourth side are on opposing sides of the expandable software package, wherein the first side is configured to expand into the second configuration to accommodate the plurality of documents by unfolding a first side flap folded into the first side, wherein the first side flap comprises a first plurality of expandable portions and a first plurality of folds, wherein when the first side flap is unfolded, at least one of the first plurality of expandable portions of the first side flap expands the second side and at least a different one of the first plurality of expandable portions of the first side flap expands the third side, wherein the fourth side is configured to expand into the second configuration to accommodate the plurality of documents by unfolding a fourth side flap folded into the fourth side, wherein the fourth side flap comprises a second plurality of expandable portions and a second plurality of folds, and wherein when the fourth side flap is unfolded, at least one of the second plurality of expandable portions of the fourth side flap expands the second side and at least a different one of the second plurality of expandable portions of the fourth side flap expands the third side, wherein the expandable software package further comprises a communication printed on the first plurality of expandable portions and the first plurality of folds of the first side flap, wherein the communication is not visible to a user when the first side flap is folded into the first side in the first configuration having the first volume, wherein the communication is visible to the user when the first side flap is unfolded from the first side in the second configuration having the second volume, and wherein the second volume exceeds the first volume, and wherein the expandable software package further comprises:

a first pair of fasteners affixed to two different folds of the first plurality of folds, wherein the first pair of fasteners are coupled with each other to keep the package in the unexpanded configuration, a second pair of fasteners affixed to an expandable portion that extends from the second side of the package, a third pair of fasteners affixed to two different portions of the first plurality of expandable portions, wherein the second pair of fasteners are coupled with the third pair of fasteners in the unexpanded configuration, and wherein the first pair of fasteners are coupled with the second pair of fasteners in the expanded configuration.

7. The apparatus of claim 6, wherein the expandable software package further comprises a folded section that is unfolded to expand the expandable software package into the second configuration.

8. The apparatus of claim 6, further comprising at least one partition internal to the expandable software package.

9. The apparatus of claim 8, wherein the partition includes at least one tab configured to fold out.

10. The apparatus of claim 6, further comprising a lid along a top side of the expandable software package, wherein the lid is configured to be expanded by unfolding a top side flap coupled to the lid, wherein the expanded lid covers an opening created by expanding the second side and the third side.

11. The apparatus of claim 6, wherein the first configuration comprises a first portion with an opening on at least one side and a second portion, at least partially inside the first portion opening, wherein the first portion and the second portion are operable to enclose the software medium, wherein the second portion is configured to be moved out of the open side of the first portion to expand the expandable package into the second configuration, and wherein the first portion and the second portion are configured to interlock in the second configuration.

12. A method, comprising:

acquiring a software product in a package having an unexpanded volume;

expanding the package into an expanded volume, wherein at least one dimension of the expanded volume is greater than a corresponding dimension of the unexpanded volume; and storing a plurality of documents related to use of the software product in the package after expanding the package, wherein at least one dimension of the plurality of documents exceeds at least one corresponding dimension of the unexpanded volume, wherein the package comprises at least a first side, a second side, a third side, and a fourth side coupled to each other, wherein the second side and third side are on opposing sides of the package and the first side and the fourth side are on opposing sides of the package, wherein the first side is configured to expand to the expanded volume to accommodate the plurality of documents by unfolding a first side flap folded into the first side, wherein the first side flap comprises a first plurality of expandable portions and a first plurality of folds, wherein when the first side flap is unfolded, at least one of the first plurality of expandable portions of the first side flap expands the second side and at least a different one of the first plurality of expandable portions of the first side flap expands the third side, wherein the fourth side is configured to expand to the expanded volume to accommodate the plurality of documents by unfolding a fourth side flap folded into the fourth side, wherein the fourth side flap comprises a second plurality of expandable portions and a second plurality of folds, and wherein when the fourth side flap is unfolded, at least one of the second plurality of expandable portions of the fourth side flap expands the second side and at least a different one of the second plurality of expandable portions of the fourth side flap expands the third side, wherein the first side comprises a printed communication on the first plurality of expandable portions and the first plurality of folds of the first side flap, wherein the communication is not visible to a user when the first side flap is folded into the first side of the package having the unexpanded volume, wherein the communication is visible to the user when the first side flap is unfolded from the first side of the package having the expanded volume, and wherein the expanded volume exceeds the unexpanded volume, and wherein the package further comprises:

a first pair of fasteners affixed to two different folds of the first plurality of folds, wherein the first pair of fasteners are coupled with each other to keep the package in the unexpanded configuration, a second pair of fasteners affixed to an expandable portion that extends from the second side of the package, a third pair of fasteners affixed to two different portions of the first plurality of expandable portions, wherein the second pair of fasteners are coupled with the third pair of fasteners in the unexpanded configuration, and wherein the first pair of fasteners are coupled with the second pair of fasteners in the expanded configuration.

13. The method of claim 12, further comprising storing the package in a conventional file cabinet after expanding the package.

14. The method of claim 12, wherein the software product is financial software.

15. The apparatus of claim 1, wherein at least one of the first plurality of expandable portions and at least one of the second plurality of expandable portions are affixed with a hanging extension.

* * * * *